US011317231B2

(12) United States Patent
Vilkamo et al.

(10) Patent No.: US 11,317,231 B2
(45) Date of Patent: Apr. 26, 2022

(54) SPATIAL AUDIO SIGNAL FORMAT GENERATION FROM A MICROPHONE ARRAY USING ADAPTIVE CAPTURE

(71) Applicant: Nokia Technologies Oy, Espoo (FI)

(72) Inventors: Juha Vilkamo, Helsinki (FI); Mikko-Ville Laitinen, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 444 days.

(21) Appl. No.: 16/336,505

(22) PCT Filed: Sep. 22, 2017

(86) PCT No.: PCT/FI2017/050664

§ 371 (c)(1),
(2) Date: Mar. 26, 2019

(87) PCT Pub. No.: WO2018/060550

PCT Pub. Date: Apr. 5, 2018

(65) Prior Publication Data

US 2021/0281964 A1 Sep. 9, 2021

(30) Foreign Application Priority Data

Sep. 28, 2016 (GB) ..... 1616478

(51) Int. Cl.
*H04S 7/00* (2006.01)
*G10L 19/008* (2013.01)
*H04R 3/00* (2006.01)

(52) U.S. Cl.
CPC ..... *H04S 7/30* (2013.01); *G10L 19/008* (2013.01); *H04R 3/005* (2013.01); *H04S 2400/15* (2013.01); *H04S 2420/01* (2013.01); *H04S 2420/07* (2013.01)

(58) Field of Classification Search
CPC .... H04S 7/30; H04S 2400/15; H04S 2420/01; H04S 2420/07; G10L 19/008; H04R 3/005
See application file for complete search history.

(56) References Cited

U.S. PATENT DOCUMENTS

2013/0223658 A1 8/2013 Betlehem et al. ..... 381/307
2014/0016802 A1* 1/2014 Sen ..... H04S 3/002 381/307
2014/0023196 A1* 1/2014 Xiang ..... H04S 7/30 381/17
2015/0154971 A1* 6/2015 Boehm ..... G10L 19/0212 704/500
2016/0057556 A1* 2/2016 Boehm ..... G10L 19/008 381/23

FOREIGN PATENT DOCUMENTS

EP 2154677 A1 2/2010
JP 2011-530915 A 12/2011
WO WO 2015/175981 A1 11/2015

* cited by examiner

*Primary Examiner* — David L Ton
(74) *Attorney, Agent, or Firm* — Harrington & Smith

(57) ABSTRACT

Apparatus including a processor configured to: receive at least two microphone audio signals; determine spatial metadata associated with the at least two microphone audio signals; and synthesize adaptively a plurality of spherical harmonic audio signals based on at least one microphone audio signal and the spatial metadata in order to output a pre-determined order spatial audio signal format.

21 Claims, 7 Drawing Sheets

99

SPATIAL AUDIO SIGNAL FORMAT GENERATION FROM A MICROPHONE ARRAY USING ADAPTIVE CAPTURE

CROSS REFERENCE TO RELATED APPLICATION

This patent application is a U.S. National Stage application of International Patent Application Number PCT/FI2017/050664 filed Sep. 22, 2017, which is hereby incorporated by reference in its entirety, and claims priority to GB 1616478.2 filed Sep. 28, 2016.

FIELD

The present application relates to apparatus and methods for generating spherical harmonic signals from a microphone array using adaptive signal processing techniques.

BACKGROUND

Two distinct classes of spatial sound capture and reproduction exist that are relevant to the following disclosure:

1) Ambisonics, in which spherical harmonic signals are linearly (non-adaptively) captured using a microphone array. The spherical harmonic signals can be decoded to loudspeakers or binaurally to headphones using classical non-adaptive methods. In binaural reproduction, the spherical harmonic signals can be rotated based on the listener head orientation using rotation matrices, and the rotated signals can then be linearly decoded binaurally.

2) Adaptive spatial audio capture (SPAC) methods, which employ dynamic analysis of perceptually relevant spatial information from the microphone array signals (e.g. directions of the arriving sound in frequency bands). This information, often called the spatial metadata, is applied to dynamically synthesize a spatial reproduction that is perceptually similar to the original recorded sound field. Such adaptive methods, when well implemented, are perceptually superior to Ambisonics for most practical devices, and are also applicable for a wider variety of capture device types.

The Ambisonic audio format (or spherical harmonic signals) is a classical spatial audio signal representation. Recently, this signal representation (or format) has also become a commonly implemented choice for spatial audio transmission. It consists of different orders of spherical harmonics. A zeroth order harmonic (=zero spatial frequency) is represented by an omnidirectional signal. A first order harmonic is represented by dipole patterns, and the higher orders have quadrupoles, etc. The term higher-order Ambisonics (HOA) in the following disclosure refers to techniques using the zeroth to second (or to higher) order spherical harmonic signals. There are many variants or configurations for spherical harmonic signals. For example, the relative amplitudes or the ordering of the spherical harmonics may vary in different definitions. The conversions between any such variants is typically straightforward using linear (matrix) operations.

The Ambisonic audio format (or spherical harmonic signals) can also be used as a format to transmit spatial audio. For example, YouTube 3D audio/video services have started to stream spatial audio using the first order Ambisonic format (spherical harmonic signals), consisting of one omnidirectional signal (zeroth order) and three dipole signals (first order). Although the approach is not optimum for quality nor the bit rate, the existing streaming service shows that the approach in practice produces a satisfactory experience for the end user. Furthermore, the Ambisonic audio format is a straightforward and a fully defined format. As such, it is a useful audio format for services such as YouTube and alike to use. The Ambisonic audio format signals can be linearly decoded at the receiver end and rendered to headphones (binaural) or to loudspeakers, using known methods.

The generation of spherical harmonic signals is problematic. To generate the spherical harmonic signals specialist apparatus in the form of specialist microphone arrays may be required to capture the signals using linear means. Other ways to generate spherical harmonic signals using conventional or general microphone arrangements and then processing the microphone signals using linear combination processing may produce spherical harmonic signals which produce poor quality results.

SUMMARY

There is provided according to a first aspect an apparatus comprising a processor configured to: receive at least two microphone audio signals; determine spatial metadata associated with the at least two microphone audio signals; and synthesize adaptively a plurality of spherical harmonic audio signals based on at least one microphone audio signal and the spatial metadata in order to output a pre-determined order spatial audio signal format.

The processor may be further configured to receive the at least two microphone audio signals from a microphone array.

The processor may be configured to analyse the at least two microphone audio signals to determine the spatial metadata.

The processor may be configured to further receive spatial metadata associated with the at least two microphone audio signals.

The plurality of spherical harmonic audio signals may be first order spherical harmonic audio signals.

The processor configured to synthesize adaptively a plurality of spherical harmonic audio signals based on the at least one microphone audio signals and the spatial metadata may be further configured to: synthesize adaptively the plurality of spherical harmonic audio signals for a first part of the at least one microphone audio signal and the spatial metadata; synthesize the plurality of spherical harmonic audio signals for a second part of the at least one microphone audio signal using linear operations; and combine the spherical harmonic audio signals.

The first part of at least one microphone audio signal may be a first frequency band of the at least one microphone audio signal and the second part of the at least one microphone audio signal may be a second frequency band of the at least one microphone audio signal.

The processor may be further configured to determine the first frequency band based on a physical arrangement of the at least one microphone generating the at least one microphone audio signal.

The processor configured to synthesize adaptively the plurality of spherical harmonic audio signals based on the at least one microphone audio signal and the spatial metadata may be further configured to: synthesize adaptively, for at least one order of spherical harmonic audio signals, spherical harmonic audio signals based on a first frequency band part of the at least one microphone audio signals and a first frequency part of the spatial metadata; synthesize, for at least one further order of spherical harmonic audio signals, spherical harmonic audio signals using linear operations;

and combine the at least one order of spherical harmonic audio signals and the at least one further order of spherical harmonic audio signals.

The processor may be further configured to determine the at least one order of spherical harmonic signals based on a physical arrangement of at least one microphone generating the at least one microphone audio signal.

The processor configured to synthesize adaptively the plurality of spherical harmonic audio signals based on the at least one microphone audio signal and the spatial metadata may be configured to: synthesize adaptively, for at least one spherical harmonic audio signal axis, spherical harmonic audio signals based on a first frequency band part of the at least one microphone audio signal and a first frequency part of the spatial metadata; synthesize, for at least one further spherical harmonic audio signal axis, spherical harmonic audio signals using linear operations; and combine the at least one spherical harmonic audio signal axis and the at least one further spherical harmonic audio signal axis.

The processor configured to synthesize adaptively the plurality of spherical harmonic audio signals based on the at least one microphone audio signal and the spatial metadata may be further configured to: generate a plurality of defined position synthesized channel audio signals based on the at least one microphone audio signals and a position part of the spatial metadata; synthesize adaptively spherical harmonic audio signals using linear operations on the plurality of defined position synthesized channel audio signals.

The processor configured to generate the plurality of defined position synthesized channel audio signals based on the at least one microphone audio signal and the position part of the spatial metadata may be further configured to: divide the at least one microphone audio signal into a directional part and a non-directional part based on a ratio part of the spatial metadata; amplitude-pan the directional part of the at least one microphone audio signal to generate a directional part of the defined position synthesized channel audio signals based on a position part of the spatial metadata; decorrelation synthesize an ambience part of the defined position synthesized channel audio signals from the non-directional part of the at least one microphone audio signal; and combine the directional part of the defined position synthesized channel audio signals and the non-directional part of the defined position synthesized channel audio signals to generate the plurality of defined position synthesized channel audio signals.

The processor configured to synthesize adaptively the plurality of spherical harmonic audio signals based on the at least one microphone audio signal and the spatial metadata may be further configured to: generate a modelled moving source set of spherical harmonic audio signals based on the at least one microphone audio signal and a position part of the spatial metadata; generate an ambience set of spherical harmonic audio signals based on the at least one microphone audio signal; and combine the modelled moving source set of spherical harmonic audio signals and the ambience set of spherical harmonic audio signals to generate the plurality of spherical harmonic audio signals.

The processor may be further configured to divide the at least one microphone audio signal into a directional part and a non-directional part based on a ratio part of the spatial metadata.

The processor configured to generate the modelled moving source set of spherical harmonic audio signals based on the at least one microphone audio signal and the position part of the spatial metadata may be further configured to: determine at least one modelled moving source weight based on the directional part of the metadata; and generate the modelled moving source set of spherical harmonic audio signals from the at least one modelled moving source weight applied to the directional part of the at least one microphone audio signal.

The processor configured to generate the ambience set of spherical harmonic audio signals based on the at least one microphone audio signal may be further configured to decorrelation synthesize the ambience set of spherical harmonic audio signals.

The processor configured to synthesize the plurality of spherical harmonic audio signals based on the at least one microphone audio signal and the spatial metadata may be further configured to: determine a target stochastic property based on the metadata; analyse the at least one microphone audio signal to determine at least one short time stochastic characteristic; generate a set of optimized weights based on the short-time stochastic characteristic and the target stochastic property; and generate a plurality of spherical harmonic audio signals based on the application of the set of weights to the at least one microphone audio signal.

The spatial metadata associated with the at least one microphone audio signal may comprise at least one of: a directional parameter of the spatial metadata for a frequency band; and a ratio parameter of the spatial metadata for the frequency band.

The at least two microphones may comprise an external microphone, a device microphone or a combination of an external microphone and a device microphone.

The at least one microphone audio signal may comprises one of the at least two microphone audio signals or an external channel.

According to a second aspect there is provided a method comprising: receiving at least two microphone audio signals; determining spatial metadata associated with the at least two microphone audio signals; and synthesizing adaptively a plurality of spherical harmonic audio signals based on at least one microphone audio signal and the spatial metadata in order to output a pre-determined order spatial audio signal format.

The method may further comprise receiving the at least two microphone audio signals from a microphone array.

Determining spatial metadata associated with the at least two microphone audio signals may further comprise analysing the at least two microphone audio signals to determine the spatial metadata.

Determining spatial metadata associated with the at least two microphone audio signals may further comprise receiving spatial metadata associated with the at least two microphone audio signals.

The plurality of spherical harmonic audio signals may be first order spherical harmonic audio signals.

Synthesizing adaptively the plurality of spherical harmonic audio signals based on the at least one microphone audio signals and the spatial metadata may further comprise: synthesizing adaptively the plurality of spherical harmonic audio signals for a first part of the at least one microphone audio signal and the spatial metadata; synthesizing the plurality of spherical harmonic audio signals for a second part of the at least one microphone audio signal using linear operations; and combining the spherical harmonic audio signals.

The first part of at least one microphone audio signal may be a first frequency band of the at least one microphone audio signal and the second part of the at least one microphone audio signal may be a second frequency band of the at least one microphone audio signal.

The method may further comprise determining the first frequency band based on a physical arrangement of the at least one microphone generating the at least one microphone audio signal.

Synthesizing adaptively the plurality of spherical harmonic audio signals based on the at least one microphone audio signal and the spatial metadata may further comprise: synthesizing adaptively, for at least one order of spherical harmonic audio signals, spherical harmonic audio signals based on a first frequency band part of the at least one microphone audio signals and a first frequency part of the spatial metadata; synthesizing, for at least one further order of spherical harmonic audio signals, spherical harmonic audio signals using linear operations; and combining the at least one order of spherical harmonic audio signals and the at least one further order of spherical harmonic audio signals.

The method may further comprise determining the at least one order of spherical harmonic signals based on a physical arrangement of at least one microphone generating the at least one microphone audio signal.

Synthesizing adaptively the plurality of spherical harmonic audio signals based on the at least one microphone audio signal and the spatial metadata may further comprise: synthesizing adaptively, for at least one spherical harmonic audio signal axis, spherical harmonic audio signals based on a first frequency band part of the at least one microphone audio signal and a first frequency part of the spatial metadata; synthesizing, for at least one further spherical harmonic audio signal axis, spherical harmonic audio signals using linear operations; and combining the at least one spherical harmonic audio signal axis and the at least one further spherical harmonic audio signal axis.

Synthesizing adaptively the plurality of spherical harmonic audio signals based on the at least one microphone audio signal and the spatial metadata may further comprise: generating a plurality of defined position synthesized channel audio signals based on the at least one microphone audio signals and a position part of the spatial metadata; and synthesizing adaptively spherical harmonic audio signals using linear operations on the plurality of defined position synthesized channel audio signals.

Generating the plurality of defined position synthesized channel audio signals based on the at least one microphone audio signal and the position part of the spatial metadata may further comprise: dividing the at least one microphone audio signal into a directional part and a non-directional part based on a ratio part of the spatial metadata; amplitude-panning the directional part of the at least one microphone audio signal to generate a directional part of the defined position synthesized channel audio signals based on a position part of the spatial metadata; decorrelation synthesizing an ambience part of the defined position synthesized channel audio signals from the non-directional part of the at least one microphone audio signal; and combining the directional part of the defined position synthesized channel audio signals and the non-directional part of the defined position synthesized channel audio signals to generate the plurality of defined position synthesized channel audio signals.

Synthesizing adaptively the plurality of spherical harmonic audio signals based on the at least one microphone audio signal and the spatial metadata may further comprise: generating a modelled moving source set of spherical harmonic audio signals based on the at least one microphone audio signal and a position part of the spatial metadata; generating an ambience set of spherical harmonic audio signals based on the at least one microphone audio signal; and combining the modelled moving source set of spherical harmonic audio signals and the ambience set of spherical harmonic audio signals to generate the plurality of spherical harmonic audio signals.

The method may further comprise dividing the at least one microphone audio signal into a directional part and a non-directional part based on a ratio part of the spatial metadata.

Generating the modelled moving source set of spherical harmonic audio signals based on the at least one microphone audio signal and the position part of the spatial metadata may further comprise: determining at least one modelled moving source weight based on the directional part of the metadata; and generating the modelled moving source set of spherical harmonic audio signals from the at least one modelled moving source weight applied to the directional part of the at least one microphone audio signal.

Generating the ambience set of spherical harmonic audio signals based on the at least one microphone audio signal may comprise decorrelation synthesizing the ambience set of spherical harmonic audio signals.

Synthesizing the plurality of spherical harmonic audio signals based on the at least one microphone audio signal and the spatial metadata may further comprise: determining a target stochastic property based on the metadata; analysing the at least one microphone audio signal to determine at least one short time stochastic characteristic; generating a set of optimized weights based on the short-time stochastic characteristic and the target stochastic property; and generating a plurality of spherical harmonic audio signals based on the application of the set of weights to the at least one microphone audio signal.

The spatial metadata associated with the at least one microphone audio signal may comprise at least one of: a directional parameter of the spatial metadata for a frequency band; and a ratio parameter of the spatial metadata for the frequency band.

The at least two microphones may comprise an external microphone, a device microphone or a combination of an external microphone and a device microphone.

The at least one microphone audio signal may comprise one of the at least two microphone audio signals or an external channel.

According to a third aspect there is provided an apparatus comprising: means for receiving at least two microphone audio signals; means for determining spatial metadata associated with the at least two microphone audio signals; and means for synthesizing adaptively a plurality of spherical harmonic audio signals based on at least one microphone audio signal and the spatial metadata in order to output a pre-determined order spatial audio signal format.

The means for receiving at least two microphone audio signals may further receive the audio signals from a microphone array.

The means for determining spatial metadata associated with the at least two microphone audio signals may further comprise means for analysing the at least two microphone audio signals to determine the spatial metadata.

The means for determining spatial metadata associated with the at least two microphone audio signals may further comprise means for receiving the spatial metadata associated with the at least two microphone audio signals.

The plurality of spherical harmonic audio signals may be first order spherical harmonic audio signals.

The means for synthesizing adaptively the plurality of spherical harmonic audio signals based on the at least one microphone audio signals and the spatial metadata may comprise: means for synthesizing adaptively spherical harmonic audio signals for a first part of the at least one microphone audio signal and the spatial metadata; means for synthesizing spherical harmonic audio signals for a second part of the at least one microphone audio signal using linear operations; and means for combining the spherical harmonic audio signals.

The first part of at least one microphone audio signal may be a first frequency band of the at least one microphone audio signal and the second part of the at least one microphone audio signal may be a second frequency band of the at least one microphone audio signal.

The apparatus may further comprise means for determining the first frequency band based on a physical arrangement of the at least one microphone generating the at least one microphone audio signal.

The means for synthesizing adaptively the plurality of spherical harmonic audio signals based on the at least one microphone audio signal and the spatial metadata may further comprise: means for synthesizing adaptively, for at least one order of spherical harmonic audio signals, spherical harmonic audio signals based on a first frequency band part of the at least one microphone audio signals and a first frequency part of the spatial metadata; means for synthesizing, for at least one further order of spherical harmonic audio signals, spherical harmonic audio signals using linear operations; and means for combining the at least one order of spherical harmonic audio signals and the at least one further order of spherical harmonic audio signals.

The apparatus may further comprise means for determining the at least one order of spherical harmonic signals based on a physical arrangement of at least one microphone generating the at least one microphone audio signal.

The means for synthesizing adaptively the plurality of spherical harmonic audio signals based on the at least one microphone audio signal and the spatial metadata may further comprise: means for synthesizing adaptively, for at least one spherical harmonic audio signal axis, spherical harmonic audio signals based on a first frequency band part of the at least one microphone audio signal and a first frequency part of the spatial metadata; means for synthesizing, for at least one further spherical harmonic audio signal axis, spherical harmonic audio signals using linear operations; and means for combining the at least one spherical harmonic audio signal axis and the at least one further spherical harmonic audio signal axis.

The means for synthesizing adaptively the plurality of spherical harmonic audio signals based on the at least one microphone audio signal and the spatial metadata may further comprise: means for generating a plurality of defined position synthesized channel audio signals based on the at least one microphone audio signals and a position part of the spatial metadata; and means for synthesizing adaptively spherical harmonic audio signals using linear operations on the plurality of defined position synthesized channel audio signals.

The means for generating the plurality of defined position synthesized channel audio signals based on the at least one microphone audio signal and the position part of the spatial metadata may further comprise: means for dividing the at least one microphone audio signal into a directional part and a non-directional part based on a ratio part of the spatial metadata; means for amplitude-panning the directional part of the at least one microphone audio signal to generate a directional part of the defined position synthesized channel audio signals based on a position part of the spatial metadata; means for decorrelation synthesizing an ambience part of the defined position synthesized channel audio signals from the non-directional part of the at least one microphone audio signal; and means for combining the directional part of the defined position synthesized channel audio signals and the non-directional part of the defined position synthesized channel audio signals to generate the plurality of defined position synthesized channel audio signals.

The means for synthesizing adaptively the plurality of spherical harmonic audio signals based on the at least one microphone audio signal and the spatial metadata may further comprise: means for generating a modelled moving source set of spherical harmonic audio signals based on the at least one microphone audio signal and a position part of the spatial metadata; means for generating an ambience set of spherical harmonic audio signals based on the at least one microphone audio signal; and means for combining the modelled moving source set of spherical harmonic audio signals and the ambience set of spherical harmonic audio signals to generate the plurality of spherical harmonic audio signals.

The apparatus may further comprise means for dividing the at least one microphone audio signal into a directional part and a non-directional part based on a ratio part of the spatial metadata.

The means for generating the modelled moving source set of spherical harmonic audio signals based on the at least one microphone audio signal and the position part of the spatial metadata may further comprise: means for determining at least one modelled moving source weight based on the directional part of the metadata; and means for generating the modelled moving source set of spherical harmonic audio signals from the at least one modelled moving source weight applied to the directional part of the at least one microphone audio signal.

The means for generating the ambience set of spherical harmonic audio signals based on the at least one microphone audio signal may further comprise means for decorrelation synthesizing the ambience set of spherical harmonic audio signals.

The means for synthesizing the plurality of spherical harmonic audio signals based on the at least one microphone audio signal and the spatial metadata may further comprise: means for determining a target stochastic property based on the metadata; analysing the at least one microphone audio signal to determine at least one short time stochastic characteristic; means for generating a set of optimized weights based on the short-time stochastic characteristic and the target stochastic property; and means for generating a plurality of spherical harmonic audio signals based on the application of the set of weights to the at least one microphone audio signal.

The spatial metadata associated with the at least one microphone audio signal may comprise at least one of: a directional parameter of the spatial metadata for a frequency band; and a ratio parameter of the spatial metadata for the frequency band.

The at least two microphones may comprise an external microphone, a device microphone or a combination of an external microphone and a device microphone.

The at least one microphone audio signal may comprise one of the at least two microphone audio signals or an external channel.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1A:
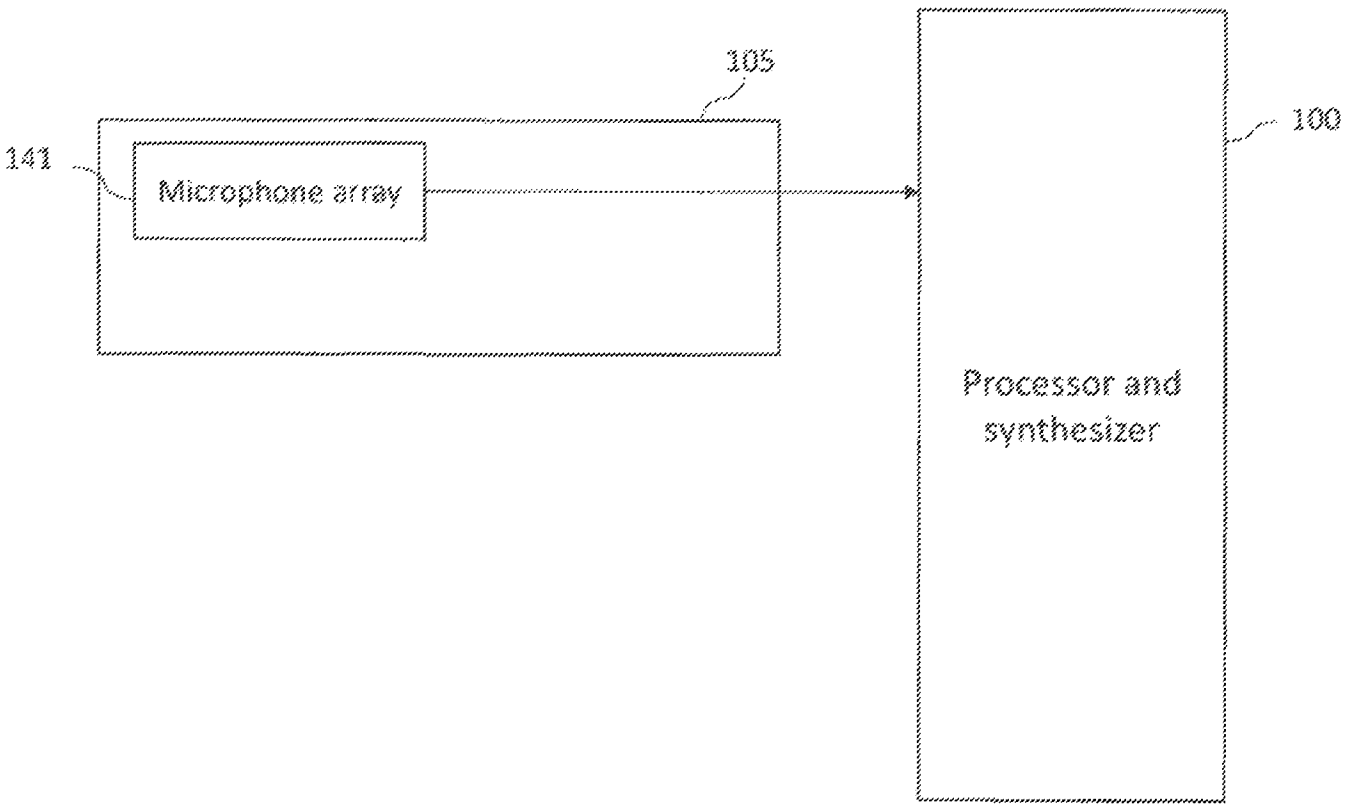
FIGS. 1*a* and 1*b* show schematically a distributed audio capture and processing system and apparatus suitable for implementing some embodiments.

The following describes in further detail suitable apparatus and possible mechanisms for the provision of effective spherical harmonic signal generation from a microphone array. In the following examples, audio signals and audio capture signals are described. However it would be appreciated that in some embodiments the apparatus may be part of any suitable electronic device or apparatus configured to capture an audio signal or receive the audio signals and other information signals. In the following the term spherical harmonics denote harmonics over space. Furthermore as explained in further detail hereafter adaptive means denote that the processing is adaptive with respect to the properties of the signal that is processed. Thus as described hereafter features may be extracted from the audio signals, and the signals processed differently depending on these features. The embodiments described herein describe the adaptive processing in terms of at least at some frequency bands and/or spherical harmonic orders, and/or spatial dimensions. Thus in contrast to conventional ambisonics there is no linear correspondence between output and input.

The following disclosure specifically describes adaptive SPAC techniques which represent methods for spatial audio capture from microphone arrays previously to loudspeakers or headphones. The embodiments as described hereafter are concerned with enabling the compatibility of SPAC capture methodology with spherical harmonic signal representation. In other words, to enable the output of the systems utilizing the dynamic SPAC analysis to be compatible with existing Ambisonic decoders. Spatial audio capture (SPAC) refers here to techniques that use adaptive time-frequency analysis and processing to provide high perceptual quality spatial audio reproduction from any device equipped with a microphone array, for example, Nokia OZO or a mobile phone. At least 3 microphones are required for SPAC capture in horizontal plane, and at least 4 microphones are required for 3D capture. The SPAC methods are adaptive, in other words they use non-linear approaches to improve on spatial accuracy from the state-of-the art traditional linear capture techniques.

The problem of traditional linear operations and methods (to capture the spherical harmonic signals from a microphone array) is that the requirements for a microphone array in order to accurately capture the audio signals are strict. For example, a first order spherical harmonic audio signal capture would require a B-format microphone with directional sensors.

Alternatively, for rigid devices such as a Nokia OZO or a smart phone, omnidirectional microphones (sensors) could be mounted on the surface of a device. In principle, based on the microphone signals the spherical harmonic signals could be retrieved using linear methods. In practice, as will be further discussed in detail below, the linear methods pose excessively strict requirements for many relevant practical use cases.

A first linear approach is to apply a matrix of designed linear filters to the microphone signals to obtain the spherical harmonic components. An equivalent alternative linear approach is to transform the microphone signals to the time-frequency domain, and for each frequency band use a designed mixing matrix to obtain the spherical harmonic signals in the time-frequency domain. The resultant spherical harmonic signals in the time-frequency domain are then inverse-transformed back to time-domain PCM signals.

However, due to fundamental constraints of linear spatial audio capture (discussed in further detail below), the device must firstly be sufficiently large for low-frequency capture (e.g. size of OZO which is approximately 260×170×160 mm), and the microphone spacing must be sufficiently dense for high-frequency capture (e.g. 2 cm apart). This produces a requirement for a large number of microphones. An example of a device fulfilling both these properties satisfactorily simultaneously is a 32-microphone Eigenmike, which is an audio-only solution.

The issue with the application of linear methods to OZO-sized devices with for example 8 microphones is that the medium to high auditory frequencies (for example, above 1.5 kHz) have a wavelength that is too small in comparison to the microphone spacing. At these frequencies the well-known effect of spatial aliasing occurs. This means that spherical harmonic audio signals no longer retain their intended spatial capture patterns, and as the result, any decoding of such signals to loudspeakers or headphones will be spatially wrong at these frequencies. For example, it may occur that the reproduced sound is perceived arriving from a wrong direction, or that the directional perception is vague. In other words, traditional linear methods do not enable the capture of spherical harmonic audio signals in a satisfactory auditory bandwidth using an OZO or any similar device.

The issue with small devices is the large wavelength at low frequencies with respect to the array size. At low frequencies (for example 200 Hz) the audio wavelength is 1.7 meters. A small device, which may be a smartphone, may have microphones located 2 cm apart. Since the audio wavelength is long, the sound arriving to the different microphones is very similar. The 1st and higher order spherical harmonics are formulated from the differences between the microphone signals, and this difference signal can with small devices be very small in amplitude with respect to the microphone self-noise or other interferences. For example, at 200 Hz the assumed small device can suffer from approximately 20 dB reduced signal-to-noise ratio at the 1st order spherical harmonics. The effect is larger for higher orders of spherical harmonics. The higher order linear capture also requires many microphones (for example 9 or more), which is not practical for small devices. In other words, traditional linear methods do not enable the capture of spherical harmonic audio signals in a satisfactory auditory bandwidth using a mobile phone or any similar device.

As a summary of the above, with the OZO device the microphones are too sparse for higher frequencies, and for small devices such as a mobile phone the array size is too small for the low frequencies.

In other words, for devices other than the high-end arrays such as the 32-microphone Eigenmike, a large proportion of the auditory frequency range is not well captured with traditional linear methods. This issue is equivalent in all linear, i.e., non-adaptive spatial capture techniques, and not only when the spherical harmonic representation is employed. Hence, for a large portion of the practical device categories it is a requirement to employ adaptive SPAC methods for spatial audio capture, also in context of generating spherical harmonics.

Although to overcome this problem and linearly obtain the spherical harmonic signals at a satisfactory bandwidth an approach may be to equip the OZO-type camera with many high-quality microphones, such as 32 or more, this produces a complex and significantly more expensive device. The concept in these embodiments is to build the device with fewer microphones, such as 8, which is simpler and more cost-efficient. For small devices such as a hand-held spherical camera or a smart phone, there is no such a prior art linear capture option available.

Similarly although for audio/video capture it is possible to use an external high-quality microphone array enabling linear spherical harmonic capture additionally to the video capture means, it is more convenient to use directly the microphones mounted on a video device itself.

There exist many high-quality methods for adaptive perceptually motivated spatial audio capture. The concept as described in further detail herein is use a SPAC method in generation of spherical harmonic audio signals from a microphone array. Specifically in some embodiments to use the SPAC methods to enable spherical harmonic signal generation with a microphone array for which at least at some frequencies it is not possible to satisfactorily linearly retrieve the spherical harmonic signals.

The term SPAC is used in this document as a generalized term covering any adaptive array signal processing technique providing spatial audio capture. The methods in scope apply the analysis and processing in frequency band signals, since it is a domain that is meaningful for spatial auditory perception. Spatial metadata such as directions of the arriving sounds, and/or ratio or energy parameters determining the directionality or non-directionality of the recorded sound, are dynamically analyzed in frequency bands. The metadata is applied at the reproduction stage to dynamically synthesize spatial sound to headphones or loudspeakers with a spatial accuracy beyond that obtainable with Ambisonics using an equivalent microphone array. For example, a plane wave arriving to the array can be reproduced as a point source at the receiver end, which is comparable to the performance of very high order Ambisonic reproduction.

One method of spatial audio capture (SPAC) reproduction is Directional Audio Coding (DirAC), which is a method using sound field intensity and energy analysis to provide spatial metadata that enables the high-quality adaptive spatial audio synthesis for loudspeakers or headphones. Another example is harmonic planewave expansion (Harpex), which is a method that can analyze two plane waves simultaneously, which may further improve the spatial precision in certain sound field conditions. A further method is a method intended primarily for mobile phone spatial audio capture, which uses delay and coherence analysis between the microphones to obtain the spatial metadata, and its variant for devices containing more microphones and a shadowing body, such as OZO. Although two variants are described in the following examples, any suitable method applied to obtain the spatial metadata can be used. The concept as such is one where from the microphone signals a set of spatial metadata (such as in frequency bands the directions of the sound, and the relative amount of non-directional sound such as reverberation) is analysed from microphone audio signals, and which enable the adaptive accurate synthesis of the spatial sound.

The use of SPAC methods are also robust for small devices for two reasons: Firstly, they typically use short-time stochastic analysis, which means that the effect of noise is reduced at the estimates. Secondly, they typically are designed for analysing perceptually relevant properties of the sound field, which is the primary interest in spatial audio reproduction. The relevant properties are typically direction(s) of arriving sounds and their energies, and the amount of non-directional ambient energy. The energetic parameters can be expressed in many ways, such as in terms of a direct-to-total ratio parameter, ambience-to-total ratio parameter, or other. The parameters are estimated in frequency bands, because in such a form these parameters are particularly relevant for human spatial hearing. The frequency bands could be Bark bands, equivalent rectangular bands (ERBs), or any other perceptually motivated non-linear scale. Also linear frequency scales are applicable, although in this case it is desirable that the resolution is sufficiently fine to cover also the low frequencies at which the human hearing is most frequency selective.

The use of SPAC analysis thus provides the perceptually relevant dynamic spatial metadata, e.g. the direction(s) and energy ratio(s) in frequency bands. The SPAC synthesis refers to processing of the audio signals to obtain for the reproduced sound the perceptual spatial characteristics according to the analysed spatial metadata. For example, if the SPAC analysis provides an information that the sound in a frequency band arrives to the microphone array from a particular direction, the SPAC synthesis stage could for example apply to the signals the head-related transfer function (HRTFs) corresponding to that direction. As the result, the reproduced sound over headphones at that frequency is perceptually similar as if an actual sound would arrive at the analysed direction. The same procedure may be applied to all other frequency bands as well (usually independently), and adaptively over time.

Similarly, many SPAC analysis and synthesis methods also account for ambience signals such as reverberation, which are typically reproduced spatially spread at the synthesis stage, adaptively in time and in frequency according to the spatial metadata.

The examples thus as described with respect to FIGS. 1*a*, 1*b*, 2 to 5 show embodiments where a SPAC method is applied to adaptively synthesize any-order spherical harmonic signals from a microphone array with which at least for some frequencies it is not possible to obtain a first order spherical harmonic representation.

For example, as described previously spatial aliasing may prevent generation of first-order spherical harmonic audio signals, or the device shape (e.g. smart phone) may prevent generation of a practically usable spherical harmonic component (due to SNR) at the axis of the narrow direction of the device.

In the embodiments described herein:

Firstly the spatial metadata (e.g., direction(s), ratio(s)) are determined from an analysis of the frequency band signals from the captured microphone audio signals.

Secondly, this spatial metadata information is then applied in synthesis of the spherical harmonic frequency band signals from at least one of the microphone array frequency band signals.

By implementing such embodiments it may be possible to enable spatial sound reproduction through channels such as YouTube for a broad range of devices, such as OZO, mobile phones, Ricoh Theta type devices, or any other, where the prior techniques fail at least at some frequencies.

As is shown in further detail later in some embodiments a hybrid approach may be employed for spatial sound reproduction wherein for some frequencies and/or spherical harmonic orders and/or spatial axes the microphone audio signals can be processed using linear methods while for other some frequencies and/or spherical harmonic orders and/or spatial axes the microphone audio signals are processed with dynamic (i.e. adaptive) processes. The hybrid approach can be beneficial for such configurations where for example linear methods can produce very high quality spherical harmonic components only for certain frequencies, and/or for certain spherical harmonic orders, and/or for certain spatial axes.

With respect to FIG. 1*a* is shown an example audio capture and processing system 99 suitable for implementing some embodiments.

The system 99 may further comprise a spatial audio capture (SPAC) device 105. The spatial audio capture device 105 may in some embodiments comprise a directional or omnidirectional microphone array 141 configured to capture an audio signal associated with a sound field represented for example by the sound source(s) and ambient sound. The spatial audio capture device 105 may be configured to output the captured audio signals to the processor and synthesizer 100.

In some embodiments the spatial audio capture device 105 is implemented within a mobile device/OZO, or any other device with or without cameras. The spatial audio capture device is thus configured to capture spatial audio, which, when rendered to a listener, enables the listener to experience the spatial sound similar to that if they were present in the location of the spatial audio capture device.

The system 99 furthermore may comprise a processor and synthesizer 100 configured to receive the outputs of the microphone array 141 of the spatial audio capture device 105.

The processor and synthesizer 100 may be configured to process (for example adaptively mix) the outputs of the spatial audio capture device 105 and output these processed signals as spherical harmonic audio signals to be stored internally or transmitted to other devices (for example to be decoded and rendered to a user). Typically, the processing is adaptive and takes place in frequency bands.

Figure 1B:
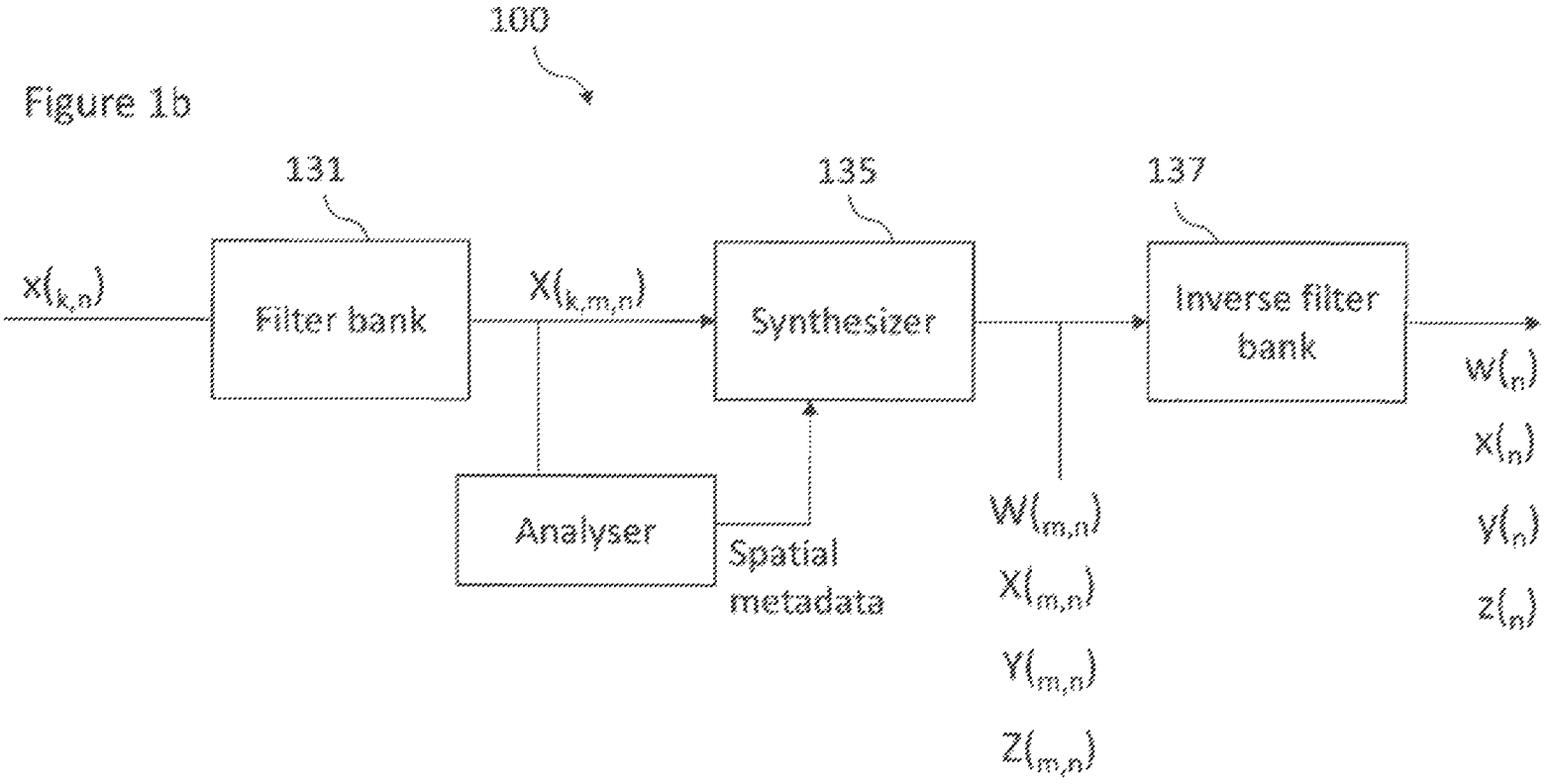

FIG. 1*b* shows an example processor and synthesizer 100 in further detail. The processor and synthesizer 100 is configured to receive audio signals/streams. For example the processor and synthesizer 100 may be configured to receive audio signals from the microphone array 141 (within the spatial audio capture device 105). The input may in some embodiments be 'recorded' or stored audio signals. In some embodiments the audio input may comprise sampled audio signals and metadata describing audio source or object directions or locations, or other directional parameters such as analysed SPAC metadata, including for example directional parameters and energy ratio parameters in frequency bands. In some embodiments the audio input signal (which includes the audio input signals associated with the microphones) may comprise other optional parameters such as gain values, or equalisation filters to be applied to the audio signals.

If the input signal contains also loudspeaker signals or audio-object signals, such can be processed into the spherical harmonic signals using conventional methods, in other words, by applying the spherical harmonic transform weights according to the spatial direction(s) to the input channel signals. Such processing is straightforward and different than the SPAC processing which relies on the perceptually motivated spatial metadata analysis in frequency bands.

The processor and synthesizer 100 in some embodiments comprises a filter-bank 131. The filter-bank 131 enables the time domain microphone audio signals to be transformed into frequency band signals. As such any suitable time to frequency domain transform may be applied to the microphone signals. A typical filter-bank which may be implemented in some embodiments is a short-time Fourier transform (STFT), involving an analysis window and FFT. Other suitable transforms in place of the STFT may be a complex-modulated quadrature mirror filter (QMF) bank. The filter-bank may produce complex-valued frequency band signals, indicating the phase and the amplitude of the input signals as a function of time and frequency. The filter bank may be uniform in its frequency resolution which enables highly efficient signal processing structures. However uniform frequency bands may be grouped into a non-linear frequency resolution approximating a spectral resolution of human spatial hearing.

For example where the microphone array 141 of the spatial audio capture device 105 comprises M microphones. The filter-bank 131 may receive microphone signals x(m,n'), where m and n' are indices for microphone and time respectively and transform the input signals into the frequency band signals by means of a short time Fourier transform $$X(k,m,n)=F(x(m,n')),$$

where X denotes the transformed frequency band signals, and k denotes the frequency band index, and n denotes the time index.

These signals may then be output to the synthesizer 135 and to the analyzer 133.

The processor and synthesizer 100 in some embodiments comprises the analyser 133 which is configured to analyse the audio signals from the filter-bank 131 and determine spatial metadata associated with the sound field at the recording position.

The SPAC analysis (any such technique) may be applied on the frequency band signals (or groups of them) to obtain the spatial metadata. A typical example of the spatial metadata is direction(s) and direct-to-total energy ratio(s) at each frequency interval and at each time frame. For example, it is an option to retrieve the directional parameter based on inter-microphone delay-analysis, which in turn can be performed for example by formulating the cross-correlation of the signals with different delays and finding the maximum correlation. Another method to retrieve the directional parameter is to use the sound field intensity vector analysis, which is the procedure applied in Directional Audio Coding (DirAC).

At the higher frequencies (above spatial aliasing frequency) it is an option to use the device acoustic shadowing for some devices such as OZO to obtain the directional information. The microphone signal energies are typically higher at that side of the device where most of the sound arrives, and thus the energy information can provide an estimate for the directional parameter.

There are many further methods in the field of array signal processing to estimate the direction-of-arrival.

It is also an option to use inter-microphone coherence analysis to estimate the amount of the non-directional ambience at each time-frequency interval (in other words, the energy ratio parameter). The ratio parameter can be estimated also with other methods, such as using a stability measure of the directional parameter, or similar. The specific method applied to obtain the spatial metadata is not of main interest in the present scope.

In this section, one method using delay estimation based on correlation between audio input signal channels is described. In this method the direction of arriving sound is estimated independently for B frequency domain subbands. The idea is to find at least one direction parameter for every subband which may be a direction of an actual sound source, or a direction parameter approximating the combined directionality of multiple sound sources. For example, in some cases the direction parameter may point directly towards a single active source, while in other cases, the direction parameter may, for example, fluctuate approximately in an arc between two active sound sources. In presence of room reflections and reverberation, the direction parameter may fluctuate more. Thus, the direction parameter can be considered a perceptually motivated parameter: Although for example one direction parameter at a time-frequency interval with several active sources may not point towards any of these active sources, it approximates the main directionality of the spatial sound at the recording position. Along with the ratio parameter, this directional information roughly captures the combined perceptual spatial information of the multiple simultaneous active sources. Such analysis is performed each time-frequency interval, and as the result the spatial aspect of the sound is captured in a perceptual sense. The directional parameters fluctuate very rapidly, and express how the sound energy fluctuates through the recording position. This is reproduced for the listener, and the listener's hearing system then gets the spatial perception. In some time-frequency occurrences one source may be very dominant, and the directional estimate points exactly to that direction, but this is not a general case.

The frequency band signal representation is denoted as X(k,m,n) where m is the microphone index, k the frequency band index {k=0, . . . , N−1} and where N is the number of frequency bands of the time-frequency transformed signals. The frequency band signal representation is grouped into B subbands, each of which has a lower frequency band index $k_b^-$ and an upper frequency band index $k_b^+$. The widths of the subbands ($k_b^+-k_b^-+1$) can approximate, for example, the ERB (equivalent rectangular bandwidth) scale or the Bark scale.

The directional analysis may feature the following operations. In this case, we assume a flat mobile device with three microphones. This configuration can provide the analysis of the directional parameter in the horizontal plane, and a ratio parameter, or similar.

First the horizontal direction is estimated with two microphone signals (in this example microphones 2 and 3 being located in the horizontal plane of the capture device at the opposing edges of the device). For the two input microphone audio signals, the time difference between the frequency-band signals in those channels is estimated. The task is to find delay $T_b$ that maximizes the correlation between two channels for subband b.

The frequency band signals X(k,m,n) can be shifted $T_b$ time domain samples using $$X_{\tau_b}(k, m, n) = X(k, m, n)e^{-j\frac{2\pi f_k \tau_b}{f_s}},$$

Where $f_k$ is the center frequency of band k, and $f_s$ is the sampling rate. The optimal delay for subband b and time index n is then obtained from $$\tau_{b,max}(n) = \max_{\tau_b} \mathrm{Re}\left(\sum_{k=k_b^-}^{k_b^+} X_{\tau_b}(k, 2, n)^* X(k, 3, n)\right), \tau_b \in [-D_{max}, D_{max}]$$

where Re indicates the real part of the result and * denotes complex conjugate, and $D_{max}$ is the maximum delay in samples, which can be a fractional number, and occurs when the sound arrives exactly at the axis determined by the microphone pair. Although an example of delay estimation over one time index n is exemplified above, in some embodiments the estimation of the delay parameter may be performed over several indices n by averaging or adding the estimates also in that axis. For $\tau_b$ the resolution of approximately one sample is for many smart phones satisfactory for the search of the delay. Also other perceptually motivated similarity measures than correlation can be used.

A 'sound source', which is a representation of the audio energy captured by the microphones, thus may be considered to create an event described by an exemplary time-domain function which is received at a microphone for example a second microphone in the array and the same event received by a third microphone. In an ideal scenario, the exemplary time-domain function which is received at the second microphone in the array is simply a time shifted version of the function received at the third microphone. This situation is described as ideal because in reality the two microphones will likely experience different environments for example where their recording of the event could be influenced by constructive or destructive interference or elements that block or enhance sound from the event, etc.

The shift $\tau_b$ indicates how much closer the sound source is to the second microphone than the third microphone (when $\tau_b$ is positive, the sound source is closer to the second microphone than the third microphone). The between −1 and 1 normalized delay can be formulated as $$\frac{\tau_{b,max}}{D_{max}}.$$

Utilizing basic geometry, and assuming that the sound is a plane wave arriving at the horizontal plane, it can be determined that the horizontal angle of the arriving sound is equal to $$\dot{\alpha}_b = \pm\cos^{-1}\left(\frac{\tau_{b,max}}{D_{max}}\right),$$

Notice that there are two alternatives for the direction of the arriving sound as the exact direction cannot be determined with only two microphones. For example, a source at a mirror-symmetric angle at the front or rear of the device may produce the same inter-microphone delay estimate.

A further microphone, for example a first microphone in an array of three microphones, can then be utilized to define which of the signs (the + or −) is correct. This information can be obtained in some configurations by estimating the delay parameter between a microphone pair having one (e.g. the first microphone) at the rear side of the smart phone, and another (e.g. the second microphone) at the front side of the smart phone. The analysis at this thin axis of the device may be noisy to produce reliable delay estimates. However, the general tendency if the maximum correlation is found at the front side or the rear side of the device may be robust. With this information the ambiguity of the two possible directions can be resolved. Also other methods may be applied for resolving the ambiguity.

The same estimation is repeated for each subband.

An equivalent method can be applied to microphone arrays where there is both 'horizontal' and 'vertical' displacement in order that the azimuth and elevation can be determined. For devices or smartphones with four or more microphones (which are displaced from each other in a plane perpendicular to the directions described above) it may be also possible to perform elevation analysis. In that case, for example, the delay analysis can be formulated first in the horizontal plane and then in the vertical plane. Then, based on the two delay estimates one can find an estimated direction of arrival. For example, one may perform a delay-to-position analysis similar to that in GPS positioning systems. In this case also, there is a directional front-back ambiguity, which is solved for example as described above.

In some embodiments the ratio metadata expressing the relative proportions of non-directional and directional sound may be generated according to the following method:

1) For the microphones with largest mutual distance the maximum-correlation delay value and the corresponding correlation value c is formulated. The correlation value c is a normalized correlation which is 1 for fully correlating signals and 0 for incoherent signals.

2) For each frequency, a diffuse field correlation value ($c_{diff}$) is formulated, depending on the microphone distance. For example, at high frequencies $c_{diff}\approx 0$. For low frequencies it may be non-zero.

3) The correlation value is normalised to find the ratio parameter:ratio=$(c-c_{diff})/(1-c_{diff})$ The resulting ratio parameter is then truncated between 0 and 1. With such an estimate method:

When c=1, then ratio=1.

When $c\leq c_{diff}$, then ratio=0.

When $c_{diff}<c<1$, then $0<\text{ratio}<1$.

The above simple formulation provides an approximation of the ratio parameter. At the extremes (the fully directional and fully non-directional sound field conditions) the estimate is true. The ratio estimate between extremes may have some bias depending on the sound arrival angle. Nevertheless, the above formulation can be demonstrated to be satisfactorily accurate in practice also in these conditions. Other methods to generate the directional and ratio parameters (or other spatial metadata depending on the applied analysis technique) are also applicable.

The aforementioned method in the class of SPAC analysis methods is intended for primarily flat devices such as smart phones: The thin axis of the device is determined suitable only for the binary front-back choice, because more accurate spatial analysis may not be robust at that axis. The spatial metadata is analysed primarily at the longer axes of the device, using the aforementioned delay/correlation analysis, and directional estimation accordingly.

A further method to estimate the spatial metadata is described in the following, providing an example of the practical minimum of two microphone channels. Two directional microphones having different directional patterns may be placed, for example 20 cm apart. Equivalently to the previous method, two possible horizontal directions of arrival can be estimated using the microphone-pair delay analysis. The front-back ambiguity can then be resolved using the microphone directivity: If one of the microphones has more attenuation towards the front, and the other microphone has more attenuation towards the back, the front-back ambiguity can be resolved for example by measuring the maximum energy of the microphone frequency band signals. The ratio parameter can be estimated using correlation analysis between the microphone pair, for example, using a similar method than as described previously.

Clearly, other spatial audio capture methods can also be suitable for obtaining the spatial metadata. In particular, for non-flat devices such as spherical devices, other methods may be more suitable, for example, by enabling higher robustness for the parameter estimation. A well-known example in the literature is Directional Audio Coding (DirAC), which in its typical form comprises of the following steps:

1) A B-format signal is retrieved, which is equivalent to the first order spherical harmonic signal.
2) The sound field intensity vector and the sound field energy are estimated in frequency bands from the B-format signal:
   a. The intensity vector can be obtained using the short-time cross-correlation estimates between the W (zeroth order) signal and the X,Y,Z (first order) signals. The direction-of-arrival is the opposite direction of the sound field intensity vector.
   b. From the absolute value of the sound field intensity and the sound field energy, a diffuseness (i.e., an ambience-to-total ratio) parameter can be estimated. For example, when the length of the intensity vector is zero, the diffuseness parameter is one.

Thus, in one embodiment the spatial analysis according to the DirAC paradigm can be applied to produce the spatial metadata, thus ultimately enabling the synthesis of the spherical harmonic signals. In other words, a directional parameter and a ratio parameter can be estimated by several different methods.

For further clarification of the aforementioned processing steps in DirAC analysis, let us specify the difference of the input B-format (i.e. spherical harmonic or Ambisonic format) signal and the reproduced output spherical harmonic signal of an overall embodiment. The input B-format signal may have excessive noise at low frequencies for the X,Y,Z components, for example, if the signals have been retrieved from a compact microphone array. The noise, however, has only a minor impact to the DirAC spatial metadata analysis, since the metadata is analysed from the short-time stochastic estimates. In specific, the stochastic analysis reduces the effect of the noise at the estimates. Therefore, an embodiment using the DirAC analysis technique could 1) robustly estimate the directional parameters, and 2) using the available high-SNR W-signal (the zeroth order signal) synthesize the spherical harmonic output signals. Thus, the output spherical harmonic signals may have a higher perceived fidelity than the input spherical harmonic signals.

The processor and synthesizer 100 in some embodiments comprises a synthesizer 135. The synthesizer 135 may be configured to receive the frequency band signal representations and the spatial metadata and be configured to generate spherical harmonic signals. The synthesizer 135 is described in further detail with respect to the examples shown in FIGS. 2 to 5. In some embodiments the spherical harmonic frequency band signals are output to an inverse filter bank 137. Although the synthesizer 135 may operate fully in the frequency domain such as shown in FIG. 1*b* it may in some embodiments, such as shown in the example shown in FIG. 2 below, operate in partially in frequency band domain and partially in the time domain. For example the synthesizer 135 may comprise a first or frequency band domain part which outputs a frequency band domain signal to the inverse filter bank 137 and a second or time domain part which receives a time domain signal from the inverse filter bank 137 and outputs suitable time domain spherical harmonic signals.

The processor and synthesizer 100 in some embodiments comprises an inverse filter-bank 137. The inverse filter-bank 137 may receive the generated spherical harmonic frequency band signals and perform a frequency to time domain transform on them in order to generate time domain representations of the spherical harmonic signals.

Figure 2:
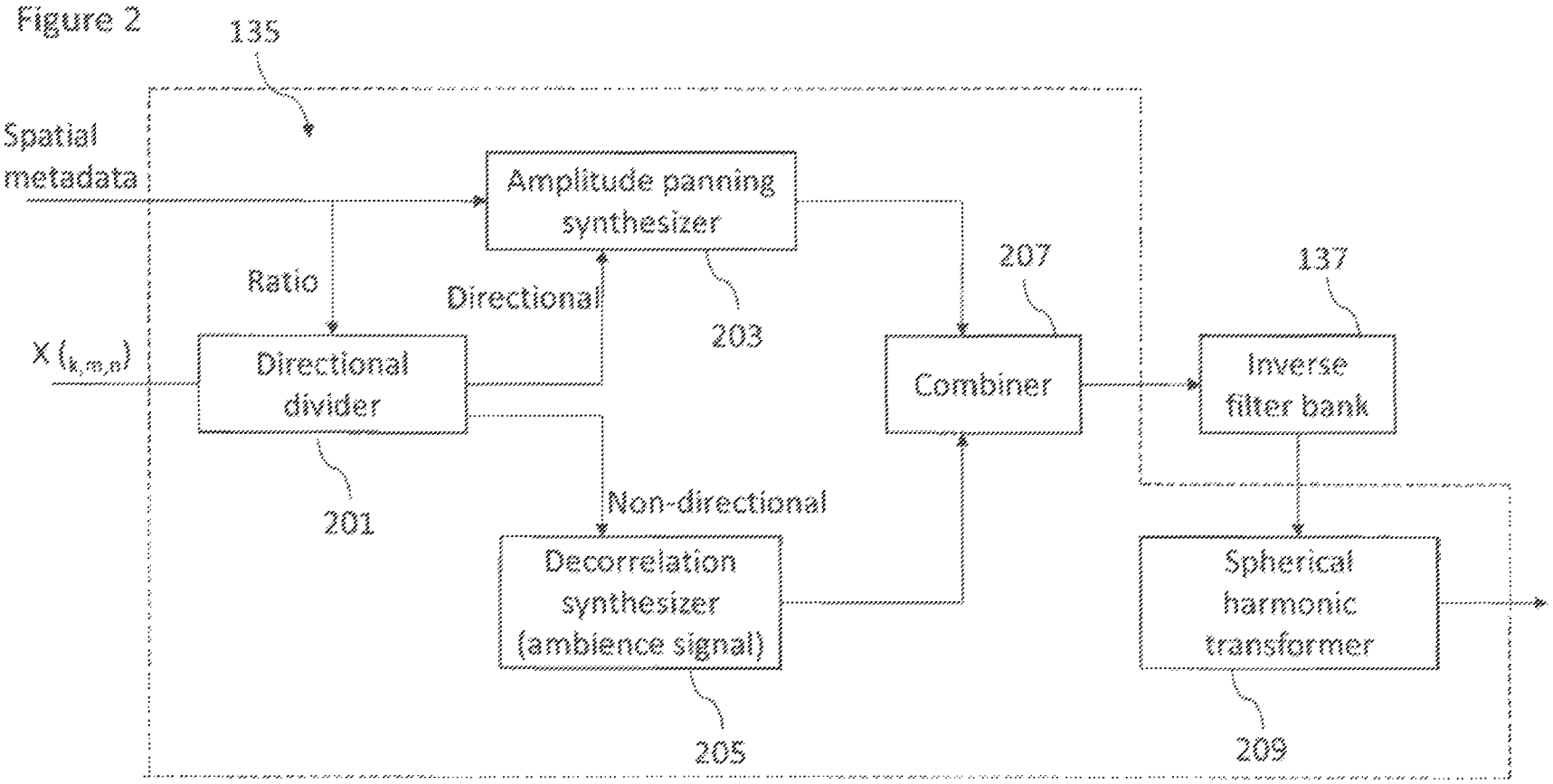
FIG. 2 shows schematically a first example of a synthesizer as shown in FIG. 1*b* according to some embodiments.

With respect to FIG. 2 a first example of a synthesizer 135 is shown. This synthesizer example is configured such that having the spatial metadata available from the SPAC analysis, the synthesizer first synthesizes an intermediate virtual multichannel loudspeaker signal, for example, 14 virtual loudspeaker channels covering a sphere in 3D and to this signal apply a spherical harmonic transform.

The synthesizer 135 may thus comprise a directional divider 201. The directional divider 201 may be configured to receive the frequency band representations and the ratio values associated with the directional components of the audio signals. The directional divider 201 may then apply the ratio values to each band in order to generate a directional and non-directional (or ambient) part of the audio signals. For example, multipliers as a function of the ratio parameters may be formulated and applied to the input frequency band signals to generate the directional and non-directional parts. The directional part may be passed to an amplitude panning synthesizer 203 and the non-directional part may be passed to a decorrelation synthesizer 205.

The synthesizer 135 may further comprise an amplitude panning synthesizer 203. The amplitude panning synthesizer 203 is configured to receive the directional part of the audio signals and furthermore the directional information part of the spatial metadata and from these generate or synthesize 'virtual' loudspeaker signals. In some embodiments there are 14 'virtual' loudspeaker channels in arranged in a 3D space. The 14 channels may for example be located such that there are 6 channels arranged in a horizontal plane, 4 channels located above the plane and 4 channels located below). However, this is only an example and there may be implemented any other number or arrangement of virtual loudspeaker channels.

The amplitude panning synthesizer may, for example, apply vector-base amplitude panning (VBAP) to reproduce the direct part of the sound at the direction determined by the spatial metadata, at each frequency band. The virtual loudspeaker signals may then be output to a combiner 207. Although the virtual loudspeaker signals may be generated by VBAP any other suitable virtual channel signal generation method may be employed. The term 'virtual' refers to that the loudspeaker signals are an intermediate representation.

The synthesizer 135 may further comprise a decorrelation synthesizer 205. The decorrelation synthesizer 205 may be configured to receive the non-directional part of the audio signal and generate an ambient or non-directional component for combining within the virtual loudspeaker signals. For example the ambient part can be synthesized for example using decorrelators to spread the sound energy to all or many of the virtual loudspeakers. The ambient part may be output to the combiner 207.

The synthesizer 135 may further comprise a combiner 207. The combiner 207 may be configured to receive the virtual loudspeaker signals and the ambient part and generate a combined directional and ambient representation using the virtual loudspeaker arrangement. This combined virtual loudspeaker frequency band representation may be passed to the inverse filter-bank 137.

The inverse filter-bank 137 may in this arrangement pass the time domain signals associated with the virtual loudspeaker representation to a spherical harmonic transformer 209.

The synthesizer 135 may further comprise a spherical harmonic transformer 209. The spherical harmonic transformer 209 may be configured to receive the time domain signals associated with the virtual loudspeaker representation and transform the virtual loudspeaker signals into spherical harmonic components by any known method. For example each virtual loudspeaker signal is weighted (with a specific weighting) and output to each of the spherical harmonic outputs. The weights can be applied for wide-band signals. The weights are formulated as a function of the azimuths and elevations of the virtual loudspeakers.

Although the example shown in FIG. 2 shows the generation of the spherical harmonic transform in the time domain it is understood that in some embodiments the spherical harmonic transform is applied in the frequency domain (or frequency band domain). In other words the spherical harmonic transformer 209 is a frequency band signal transformer and is located before the inverse filter bank 137 and after the combiner 207. The weights can be applied in this example to the frequency band signals.

Figure 3:
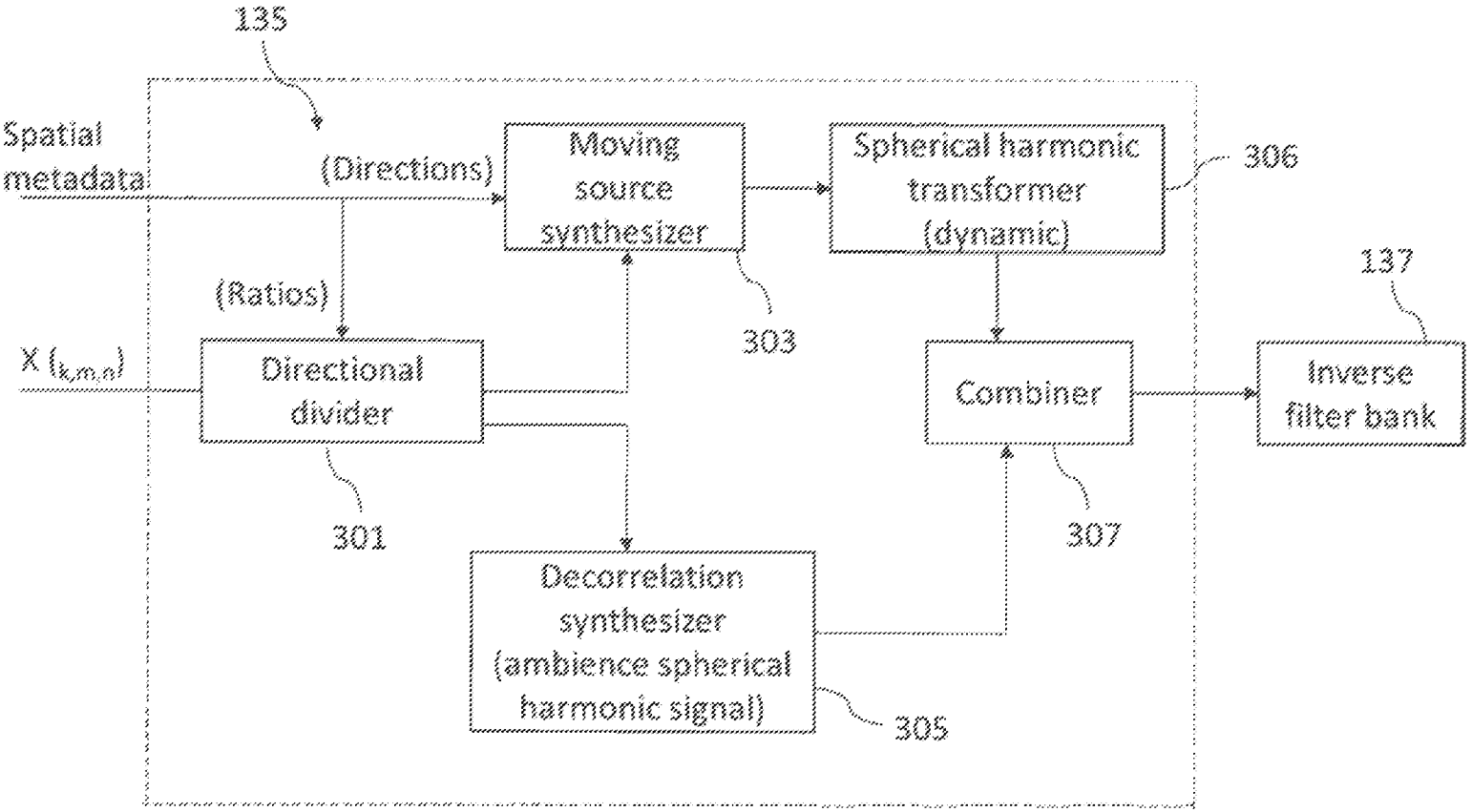
FIG. 3 shows schematically a second example of a synthesizer as shown in FIG. 1*b* according to some embodiments.

With respect to FIG. 3 a second example synthesizer 135 is shown. In this example the spherical harmonic signals could be synthesized (using the spatial metadata) directly, i.e., without an intermediate virtual loudspeaker layout representation.

The synthesizer 135 may thus comprise a directional divider 301. The directional divider 301 may be configured to receive the frequency band representations and the ratio values associated with the directional components of the audio signals. The directional divider 135 may then apply the ratio values to each band in order to generate a directional and non-directional (or ambient) part of the audio signals. The directional part may be passed to a moving source synthesizer 303 and the non-directional part may be passed to a decorrelation synthesizer 305.

The synthesizer 135 may further comprise a moving source synthesizer 303. The moving source synthesizer 303 is configured to receive the directional part of the audio signals and furthermore the directional information part of the spatial metadata and from these generate spherical harmonic transform weights associated with the moving source being modelled based on the directional analysis. For example, the directional part(s) of the audio signals can be considered as virtual moving source(s). The directional metadata may determine the direction of the moving source, and the energetic metadata (e.g. ratio parameter) determines the amount of the energy that is reproduced at that direction.

In some embodiments the directional estimates are smoothed (for example low-pass filtered over time or over frequency bands) in order to reduce sudden audible fluctuations in the output. The location of the virtual source may therefore potentially change at every time instant of each frequency band signal. Since the direction of the virtual moving source can potentially vary as a function of frequency, the spherical harmonic transform is performed for each frequency band independently and the spherical harmonic weights, which this time are adaptive in time and in frequency can be generated and passed to a spherical harmonic transformer 306 together with the audio signals.

The synthesizer 135 in some embodiments comprises a spherical harmonic transformer 306 configured to receive the determined weights and audio signals and generate the directional part of the frequency band spherical harmonic signals. The directional part of the frequency band spherical harmonic signals may then be passed to a combiner 307. In some embodiments the operations of the moving source synthesizer 303 and the spherical harmonic transformer 306 can be performed in a single operation or module.

The synthesizer 135 may further comprise a decorrelation synthesizer 305. The decorrelation synthesizer 305 may be configured to synthesize the ambient parts of the signal energy directly. This can be performed because according to the definition of spherical harmonic signals they are mutually incoherent in ideal ambience or diffuse sound fields, e.g. in reverberation. Thus, it is possible to synthesize the ambience portion by decorrelating the input microphone frequency band signals to obtain the incoherent spherical harmonic frequency band signals. These signals may be weighted weights for each of the spherical harmonic coefficients. These spherical harmonic coefficient based weights are scalars as a function of the spherical harmonic order, and depend of the applied normalization scheme. An example normalization scheme is such that for the ambience each of the spherical harmonic (SH) orders have in total the same signal energy. Thus if the zeroth order has 1 unit of energy, the three first order SH signals would have ⅓ units of energy each, the five second order SH signals would have ⅕ units of energy, and so forth. The ambient part may furthermore be output to the combiner 307. It is understood that the normalization scheme does not apply only for the ambience part, but the same weighting is incorporated as part of the formulation of the spherical transform coefficients for the direct signal part.

The synthesizer 135 may further comprise a combiner 307. The combiner 307 may be configured to receive the ambience and directional parts of the directly determined spherical harmonic signals and combine these to generate a combined frequency domain spherical harmonic signal. This combined spherical harmonic frequency band representation may be passed to the inverse filter-bank 137.

The inverse filter-bank 137 may in this arrangement output the time domain spherical harmonic representation.

Figure 4:
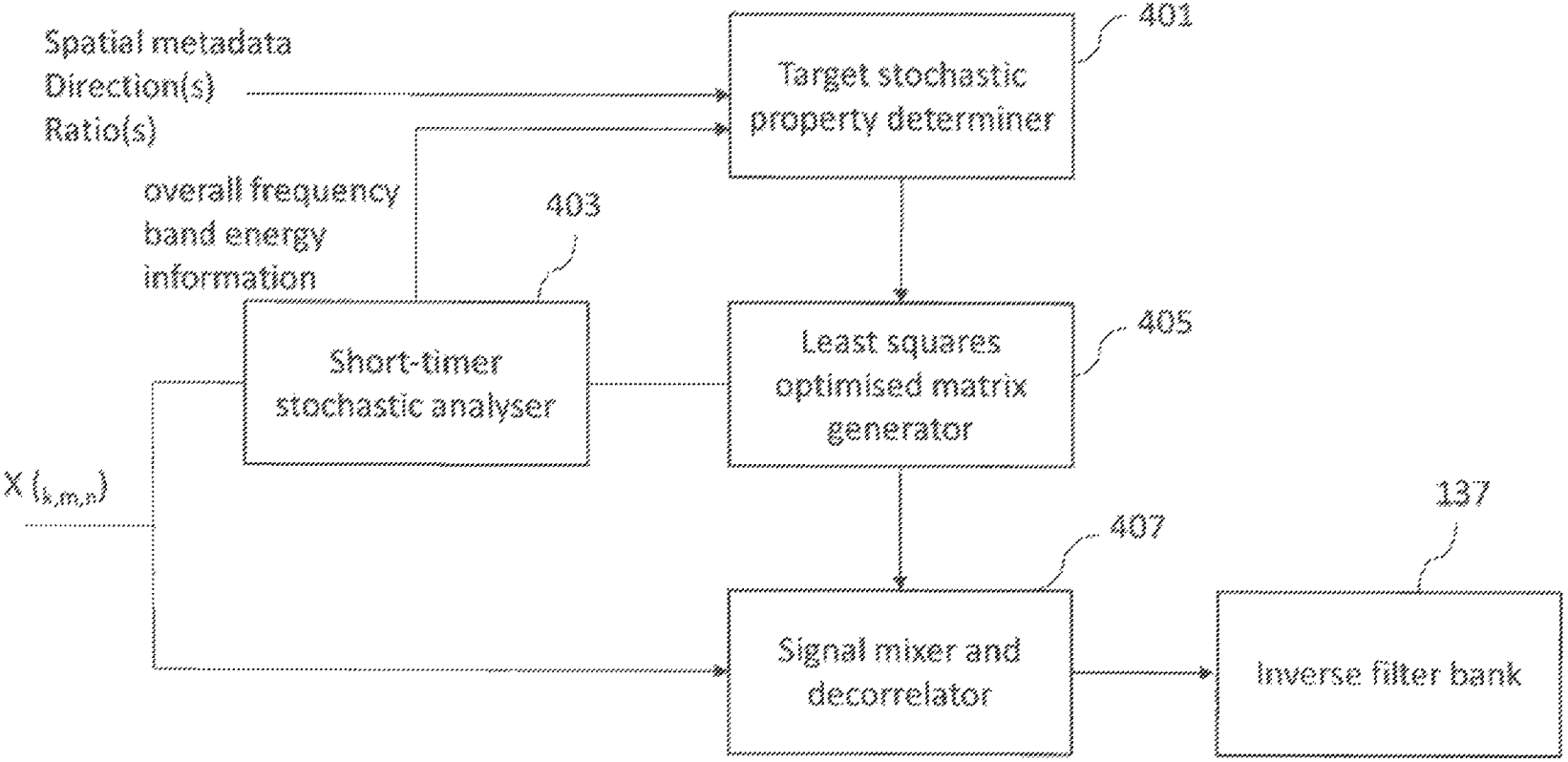
FIG. 4 shows schematically a third example of a synthesizer as shown in FIG. 1*b* according to some embodiments.

With respect to FIG. 4 a third example synthesizer 135 is shown. In this example an optimized mixing technique, such as a least-squares optimized solution, is used to generate the spherical harmonic signals based on the spatial metadata and the microphone signals in frequency bands. This approach differs from the previous examples, since it

- does not apply any virtual source (moving nor static), and
- synthesizes the direct and ambient portions at a unified step, i.e., not separately.

The synthesizer 135 may comprise a short time stochastic analyser 403. The short time stochastic analyser 403 is configured to receive the frequency domain representations and perform the short-time stochastic analysis in order to determine the covariance matrix for the frequency band microphone signals. The covariance matrix may be passed to the least squares optimized matrix generator 405.

The synthesizer 135 may comprise a target stochastic property determiner 401. The target stochastic property determiner 401 may be configured to determine the intended covariance matrix for the spherical harmonic signals based on the spatial metadata and overall frequency band energy information obtained from the short-time stochastic analysis. The intended target covariance matrix for the spherical harmonic signals can be obtained by first formulating the covariance matrix for the direct energy portion corresponding to the direction determined by the spatial metadata, second by formulating the covariance matrix for the ambience (or non-directional) energy portion, and combining these matrices to form the intended target covariance matrix. The ambience portion covariance matrix is a diagonal matrix, which expresses that the spherical harmonic signals for ambience are mutually incoherent. The relative energies of the diagonal coefficients are according to the normalization scheme as described previously. Similarly, the direct part covariance matrix is formulated using the spherical harmonic weights (being affected by normalization scheme) according to the analysed spatial metadata.

This target property may then be passed to the least squares optimized matrix generator 405.

The least squares optimized matrix generator 405 may take the stochastic estimates from the short time stochastic analyser 403 and the target property from the property determiner 401 and apply a least squares (or other suitable optimization) method to determine suitable mixing coefficients which may be passed to a signal mixer and decorrelator 407. An example implementation would in other words perform the short-time stochastic (covariance matrix) analysis for the frequency band microphone signals, formulate the intended target covariance matrix for the spherical harmonic output signals, and obtain processing gains based on at least these two matrices using the least squares optimized matrix generator 405 (for example using a method as described in, or similar to the method described in, US20140233762A1). The resulting processing gains are used as weighting values to be applied by the signal mixer and decorrelator 407.

These embodiments can thus be applied in order to synthesize the spherical harmonic signals from the microphone signals. The output of the signal mixer and decorrelator 407 is passed to the inverse filter-bank 137.

The inverse filter-bank 137 may in this arrangement output the time domain spherical harmonic representation.

As described previously in some embodiments a hybrid approach may be implemented where for some frequencies the apparatus would use traditional linear methods, and at other frequencies the SPAC methods as described above would be used, to obtain the spherical harmonic components. For example, for a Nokia OZO device linear methods could be used to obtain up to first order spherical harmonics approximately at frequencies 200-1500 Hz, and SPAC methods at the other frequencies.

Figure 5:
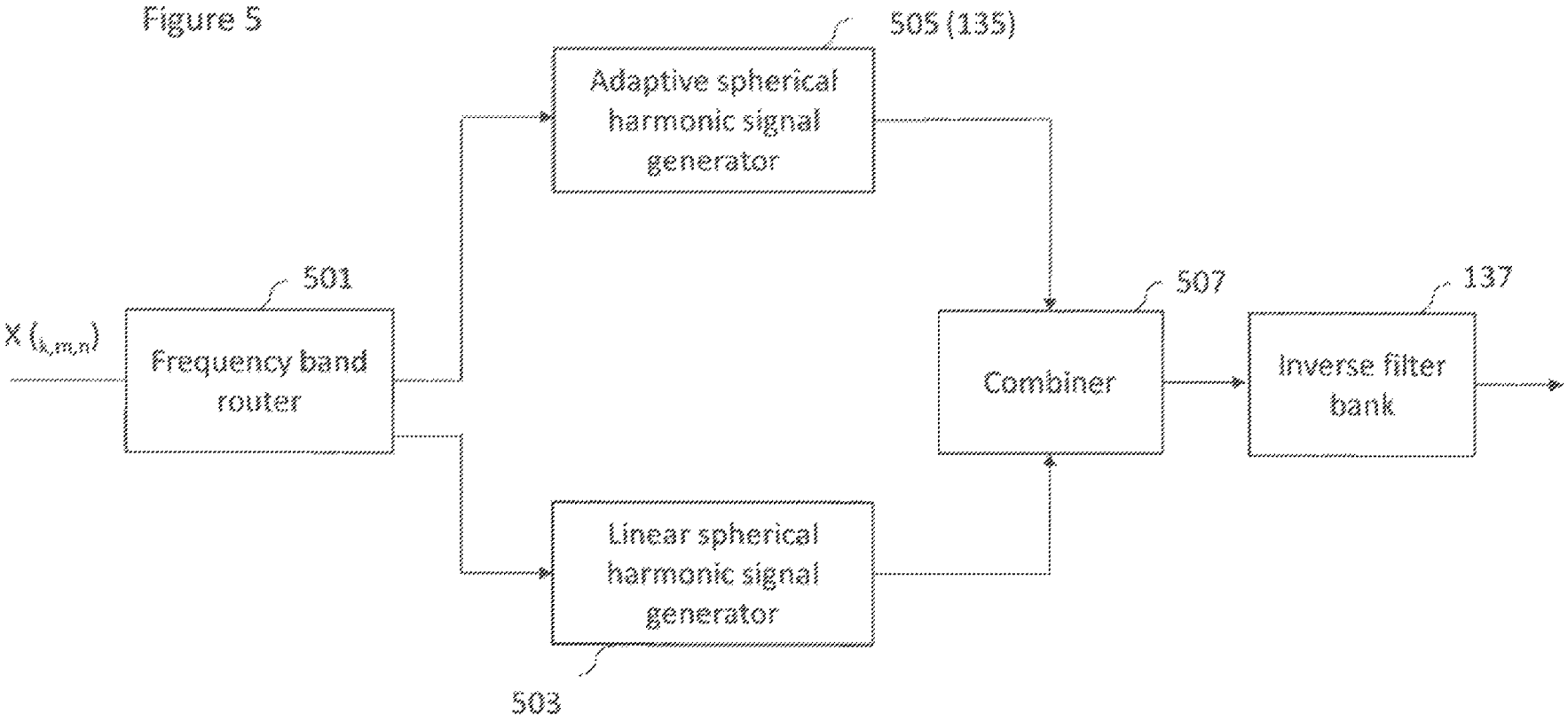
FIG. 5 shows schematically an example hybrid synthesizer as shown in FIG. 1*b* according to some embodiments.

An example block diagram of a hybrid configuration is shown in FIG. 5.

In this example the system comprises a frequency band router configured to direct some of the frequency band representations to an adaptive spherical harmonic signal generator or synthesizer 505 which may be any of the example adaptive harmonic signal synthesizers 135 as shown in FIGS. 2 to 4, and some of the frequency band representations to a linear spherical harmonic signal generator 503.

The outputs of the adaptive spherical harmonic signal generator or synthesizer 135 and linear spherical harmonic signal generator 503 are then passed to a combiner 507 which then outputs the combined spherical harmonic audio signal representation to the inverse filter-bank 137. The combination may require temporal alignment of the signals if the adaptive and linear processing have different latencies.

In other words part of the frequency bands are processed with adaptive methods and other frequency bands are processed with linear methods.

In some embodiments the hybrid approach such as shown in FIG. 5 may be applied to a spatial division rather than or as well as frequency division of the audio signals. Thus linear methods in such embodiments may be used to obtain some lower orders of the spherical harmonics, and to use the adaptive SPAC-type methods such as described to synthesize the higher orders of spherical harmonics. For example, for a Nokia OZO device, at approximately 200-1500 Hz, linear approach may be used to obtain the 0th and the 1st order spherical harmonics, and the SPAC approach to synthesize the 2nd order spherical harmonics, or also higher orders.

In some embodiments both the adaptive synthesizer and linear method synthesizer may be implemented to function sequentially. For example, at 200-1500 Hz the apparatus may first generate the 1st order spherical harmonic signals and, based on the 1st order spherical signals synthesize the higher orders using adaptive methods known in the art, or, above the spatial aliasing frequency (~1500 Hz for OZO), apply the adaptive methods described herein. Generating an intermediate 1st order signal representation at some frequencies (and thus utilizing the prior art) may be an optional step.

In any of the embodiments described herein the produced spherical harmonic signal can be of any (pre-determined) order. First, second, third or higher order harmonics are possible. Furthermore, it is understood that a mixed-order output can also be provided. For example, in some cases, not all spherical harmonic output signals for some of the orders are processed. By way of example, in some use cases it may be desirable to have a higher order spherical harmonic representation at the horizontal directions than at the vertical directions. One such a use case is when the spherical harmonic signals are known to be decoded for a loudspeaker setup with mostly horizontal loudspeakers.

In some embodiments the hybrid approach could be applied based on the spatial axis of the device. For example, a mobile phone having an irregular array may therefore have different dimensions at different axes. Therefore, at different axes the hybrid approach could be applied differently, or used only for some of the axes. For example, at the width axis of a smart phone, one could use a linear method at some frequencies to obtain the first order spherical harmonic signals, while in the thin axis of a smart phone, the SPAC methods are applied to form all orders of spherical harmonic signals above the zeroth order.

The general motivation for implementing a hybrid approach is primarily because of the simplicity of the linear methods: Although linear methods are not applicable for typical microphone arrays for a wide bandwidth, nor to produce high orders of SH coefficients, at their typical operational range they may be robust and computationally light. Thus, the hybrid approach may be a preferable configuration for some devices.

The hybrid approach may require an alignment between the linear and non-linear signal components in terms of time and/or phase, to avoid any temporal or spectral artefacts. This is since the linear methods may have a different and typically smaller latency than the adaptive methods.

In some embodiments the spatial metadata may be analysed based on at least two microphone signals of a microphone array, and the spatial synthesis of the spherical harmonic signals may be performed based on the metadata and at least one microphone signal in the same array. For example, with a smartphone, all or some of the microphones could be used for the metadata analysis, and for example only the front microphone could be used for the synthesis of the spherical harmonic signals. However, it is understood that the microphones being used for the analysis may in some embodiments be different than the microphones being used for the synthesis. The microphones could also be a part of a different device. For example, it could be that the spatial metadata analysis is performed based on the microphone signals of a presence capture device with a cooling fan. Although the metadata is obtained, these microphone signals could be of low fidelity due to, by way of example, fan noise. In such a case, one or more microphones could be placed externally to the presence capture device. The signals from these external microphones could be processed according to the spatial metadata obtained using the microphone signals from the presence capture device.

There are various configurations that may be used to obtain the microphone signals.

It is also understood that any of the microphone signals discussed herein may be pre-processed microphone signals. For example, a microphone signal could be an adaptive or non-adaptive combination of actual microphone signals of a device. For example, there could be several microphone capsules nearby each other that are combined to provide a signal with an improved SNR.

The microphone signals could also be pre-processed, such as adaptively or non-adaptively equalized, or processed with noise-removal processes. Furthermore, the microphone signals may in some embodiments be beamform signals, in other words, spatial capture pattern signals that are obtained by combining two or more microphone signals.

It is thus understood that there are many configurations, devices, and approaches to obtain the microphone signals for the processing according to the methods provided herein.

In some embodiments, there may be only one microphone or audio signal, and the associated spatial metadata has been analysed previously. For example, it may be that after the analysis of the spatial metadata using at least two microphones the number of microphone signals has been reduced for transmission or storage, for example to only one channel. After the transmission, in such an example configuration, the decoder receives only one audio channel and the spatial metadata, and then performs the spatial synthesis of the spherical harmonic signals using the methods provided herein. Clearly, there could be also two or more transmitted audio signals, and the previously analysed metadata can also in such cases be applied at the adaptive synthesis of the spherical harmonic signals.

In some embodiments the spatial metadata is analyzed from at least two microphone signals, and the metadata along with at least one audio signal are transmitted to a remote receiver, or stored. In other words, the audio signals and the spatial metadata may be stored or transmitted in an intermediate format that is different than the spherical harmonic signal format. The format, for example, may feature lower bit rate than the spherical harmonic signal format. The at least one transmitted or stored audio signal can be based on the same microphone signals using which the spatial metadata was also obtained, or based on signals from other microphones in the sound field. At a decoder, the intermediate format may be transcoded into a spherical harmonic signal format, thus enabling the compatibility with services such as YouTube. In other words, at a receiver or a decoder, the transmitted or stored at least one audio channel is processed to a spherical harmonic audio signal representation utilizing the associated spatial metadata and using the methods described herein. While transmitted or stored, in some embodiments the audio signal(s) may be encoded, for example, using AAC. In some embodiments the spatial metadata may be quantized, encoded and/or embedded to the AAC bit stream. In some embodiments the AAC or otherwise encoded audio signals and the spatial metadata may be embedded into a container such as the MP4 media container. In some embodiments the media container, being for example MP4, may include a video stream, such as an encoded spherical panoramic video stream. Many other configurations to transmit or store the audio signals and the associated spatial metadata exist.

Regardless of the applied methods to transmit or store the audio signals and the spatial metadata, at the receiver (or decoder or processor) the methods described herein provide the means to generate the spherical harmonic signals adaptively based on the spatial metadata and at least one audio signal. In other words, for the methods presented herein, it is in practice not relevant if the audio signals and/or the spatial metadata are obtained from the microphone signals directly, or indirectly, for example, through encoding, transmission/storing and decoding. With respect to FIG. 6 an example electronic device 1200 which may be used as at least part of the processor and synthesizer 100 or as part of the system 99 is shown. The device may be any suitable electronics device or apparatus. For example in some embodiments the device 1200 is a virtual or augmented reality capture device, a mobile device, user equipment, tablet computer, computer, audio playback apparatus, etc.

The device 1200 may comprise a microphone array 1201. The microphone array 1201 may comprise a plurality (for example a number M) of microphones. However it is understood that there may be any suitable configuration of microphones and any suitable number of microphones. In some embodiments the microphone array 1201 is separate from the apparatus and the audio signals transmitted to the apparatus by a wired or wireless coupling. The microphone array 1201 may in some embodiments be the SPAC microphone array 144 as shown in FIG. 1*a*.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC analysis, and synthesizing such as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

The transceiver 1209 can communicate with further apparatus by any suitable known communications protocol. For example in some embodiments the transceiver 209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as a synthesizer apparatus. As such the transceiver 1209 may be configured to receive the audio signals and determine the spatial metadata such as position information and ratios, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Figure 6:
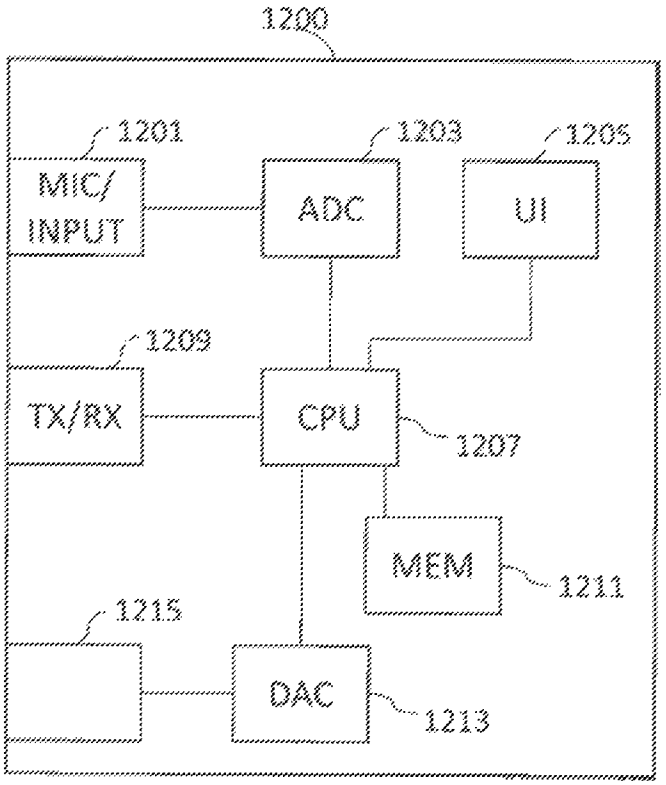
FIG. 6 shows schematically apparatus suitable for implementing embodiments.

Furthermore the device 1200 can comprise in some embodiments an audio subsystem output 1215. An example, such as shown in FIG. 6, may be where the audio subsystem output 1215 is an output socket configured to enabling a coupling with headphones 121. However the audio subsystem output 1215 may be any suitable audio output or a connection to an audio output. For example the audio subsystem output 1215 may be a connection to a multichannel speaker system. In order to be reproduced over loudspeaker or headphones, the spherical audio signals described earlier are first decoded using a spherical harmonic decoder (or Ambisonics decoder). There are Ambisonics decoders for both loudspeaker playback as well as binaural headphone playback.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that in some embodiments the device 1200 can comprise just the audio capture or audio render apparatus elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the electronic device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one processor; and at least one non-transitory memory including computer program code;

the at least one memory and the computer program code configured to, with the at least one processor, cause the apparatus at least to:

receive at least two microphone audio signals;

determine spatial metadata, the spatial metadata comprising spatial information from dynamic analysis of one or more frequency bands of the at least two microphone audio signals; and synthesize adaptively a plurality of spherical harmonic audio signals based on at least one microphone audio signal of the at least two microphone audio signals and the spatial metadata in order to output a spatial audio signal format comprising a pre-determined order.

2. The apparatus as claimed in claim 1, wherein the at least one memory and the computer program code are further configured to, with the at least one processor, cause the apparatus to at least one of:

receive the at least two microphone audio signals from a microphone array;

analyse the at least two microphone audio signals to determine the spatial metadata; or receive the spatial metadata associated with the at least two microphone audio signals.

3. The apparatus as claimed in claim 1, wherein the at least one memory and the computer program code configured to, with the at least one processor, cause the apparatus to synthesize adaptively the plurality of spherical harmonic audio signals is further configured to:

synthesize adaptively one or more first spherical harmonic audio signals for a first part of the at least one microphone audio signal and the spatial metadata;

synthesize one or more second spherical harmonic audio signals for a second part of the at least one microphone audio signal using linear operations; and combine the one or more first spherical harmonic audio signals and the one or more second spherical harmonic audio signals.

4. The apparatus as claimed in claim 3, wherein the first part of at least one microphone audio signal is a first frequency band of the at least one microphone audio signal and the second part of the at least one microphone audio signal is a second frequency band of the at least one microphone audio signal.

5. The apparatus as claimed in claim 4, wherein the at least one memory and the computer program code are further configured to, with the at least one processor, cause the apparatus to determine the first frequency band based on a physical arrangement of the at least one microphone generating the at least one microphone audio signal.

6. The apparatus as claimed in claim 1, wherein the at least one memory and the computer program code configured, with the at least one processor, to synthesize adaptively the plurality of spherical harmonic audio signals is further configured to at least one of:

determine at least one order of spherical harmonic signals based on a physical arrangement of at least one microphone generating the at least one microphone audio signal;

synthesize adaptively, for the at least one order of spherical harmonic audio signals, spherical harmonic audio signals based on a first frequency band part of the at least one microphone audio signal and a first part of the spatial metadata associated with the first frequency band part;

synthesize, for at least one further order of spherical harmonic audio signals, spherical harmonic audio signals using linear operations; or combine the at least one order of spherical harmonic audio signals and the at least one further order of spherical harmonic audio signals.

7. The apparatus as claimed in claim 1, wherein the at least one memory and the computer program code configured, with the at least one processor, to synthesize adaptively the plurality of spherical harmonic audio signals is further configured to:

synthesize adaptively, for at least one spherical harmonic audio signal axis, spherical harmonic audio signals based on a first frequency band part of the at least one microphone audio signal and a first part of the spatial metadata associated with the first frequency band part;

synthesize, for at least one further spherical harmonic audio signal axis, spherical harmonic audio signals using linear operations;

combine the at least one spherical harmonic audio signal axis and the at least one further spherical harmonic audio signal axis.

8. The apparatus as claimed in claim 1, wherein the at least one memory and the computer program code configured, with the at least one processor, to synthesize adaptively the plurality of spherical harmonic audio signals is further configured to:

generate a plurality of defined position synthesized channel audio signals based on the at least one microphone audio signal and a position part of the spatial metadata; and synthesize adaptively spherical harmonic audio signals using linear operations on the plurality of defined position synthesized channel audio signals.

9. The apparatus as claimed in claim 8, wherein the at least one memory and the computer program code configured, with the at least one processor, to generate the plurality of defined position synthesized channel audio signals is further configured to:

divide the at least one microphone audio signal into a directional part and a non-directional part based on a ratio part of the spatial metadata;

amplitude-pan the directional part of the at least one microphone audio signal to generate a directional part of the plurality of defined position synthesized channel audio signals based on the position part of the spatial metadata;

decorrelation synthesize an ambience part of the plurality of defined position synthesized channel audio signals from the non-directional part of the at least one microphone audio signal; and combine the directional part of the plurality of defined position synthesized channel audio signals and the non-directional part of the plurality of defined position synthesized channel audio signals to generate the plurality of defined position synthesized channel audio signals.

10. The apparatus as claimed in claim 1, wherein the at least one memory and the computer program code configured, with the at least one processor, to synthesize adaptively the plurality of spherical harmonic audio signals is further configured to:

generate a modelled moving source set of spherical harmonic audio signals based on the at least one microphone audio signal and a position part of the spatial metadata;

generate an ambience set of spherical harmonic audio signals based on the at least one microphone audio signal; and combine the modelled moving source set of spherical harmonic audio signals and the ambience set of spherical harmonic audio signals to generate the plurality of spherical harmonic audio signals.

11. The apparatus as claimed in claim 10, wherein the at least one memory and the computer program code configured, with the at least one processor, to generate the modelled moving source set of spherical harmonic audio signals is further configured to:

determine at least one modelled moving source weight based on a directional part of the spatial metadata; and generate the modelled moving source set of spherical harmonic audio signals from the at least one modelled moving source weight applied to a directional part of the at least one microphone audio signal.

12. The apparatus as claimed in claim 10, wherein the at least one memory and the computer program code configured, with the at least one processor, to generate the ambience set of spherical harmonic audio signals is further configured to decorrelation synthesize the ambience set of spherical harmonic audio signals.

13. The apparatus as claimed in claim 1, wherein the at least one memory and the computer program code configured, with the at least one processor, to synthesize the plurality of spherical harmonic audio signals is further configured to:

determine a target stochastic property based on the spatial metadata;

analyse the at least one microphone audio signal to determine at least one short-time stochastic characteristic;

generate a set of optimized weights based on the at least one short-time stochastic characteristic and the target stochastic property; and generate the plurality of spherical harmonic audio signals based on application of the set of optimized weights to the at least one microphone audio signal.

14. The apparatus as claimed in claim 1, wherein the spatial metadata associated with the at least one microphone audio signal comprises at least one of:

a directional parameter for a frequency band; or a ratio parameter for the frequency band.

15. A method comprising:

receiving at least two microphone audio signals;

determining spatial metadata, the spatial metadata comprising spatial information from dynamic analysis of one or more frequency bands of the at least two microphone audio signals; and synthesizing adaptively a plurality of spherical harmonic audio signals based on at least one microphone audio signal of the at least two microphone audio signals and the spatial metadata in order to output a spatial audio signal format comprising a pre-determined order.

16. The method as claimed in claim 15, wherein determining the spatial metadata associated with the at least two microphone audio signals further comprises one of:

analysing the at least two microphone audio signals to determine the spatial metadata; or receiving the spatial metadata associated with the at least two microphone audio signals.

17. The method as claimed in claim 15, wherein synthesizing adaptively the plurality of spherical harmonic audio signals further comprises:

synthesizing adaptively one or more first spherical harmonic audio signals for a first part of the at least one microphone audio signal and the spatial metadata;

synthesizing one or more second spherical harmonic audio signals for a second part of the at least one microphone audio signal using linear operations; and combining the one or more first spherical harmonic audio signals and the one or more second spherical harmonic audio signals.

18. The method as claimed in claim 15, wherein synthesizing adaptively the plurality of spherical harmonic audio signals further comprises:

synthesizing adaptively, for at least one order of spherical harmonic audio signals, spherical harmonic audio signals based on a first frequency band part of the at least one microphone audio signal and a first part of the spatial metadata associated with the first frequency band part;

synthesizing, for at least one further order of spherical harmonic audio signals, spherical harmonic audio signals using linear operations; and combining the at least one order of spherical harmonic audio signals and the at least one further order of spherical harmonic audio signals.

19. The method as claimed in claim 15, wherein synthesizing adaptively the plurality of spherical harmonic audio signals further comprises:

synthesizing adaptively, for at least one spherical harmonic audio signal axis, spherical harmonic audio signals based on a first frequency band part of the at least one microphone audio signal and a first part of the spatial metadata associated with the first frequency band part;

synthesizing, for at least one further spherical harmonic audio signal axis, spherical harmonic audio signals using linear operations; and combining the at least one spherical harmonic audio signal axis and the at least one further spherical harmonic audio signal axis.

20. A non-transitory computer-readable medium comprising program instructions stored thereon which, when executed with at least one processor, cause the at least one processor to:

receive at least two microphone audio signals;

determine spatial metadata, the spatial metadata comprising spatial information from dynamic analysis of one or more frequency bands of the at least two microphone audio signals; and synthesize adaptively a plurality of spherical harmonic audio signals based on at least one microphone audio signal of the at least two microphone audio signals and the spatial metadata in order to output a spatial audio signal format comprising a pre-determined order.

21. The apparatus as claimed in claim 1, wherein the spatial metadata is associated with spatial audio capture.

* * * * *